US007321333B2

(12) United States Patent
Tsai et al.

(10) Patent No.: US 7,321,333 B2
(45) Date of Patent: Jan. 22, 2008

(54) ANTENNA STRUCTURE

(75) Inventors: Feng-Chi Eddie Tsai, Taipei Hsien (TW); Chia-Tien Li, Taipei Hsien (TW)

(73) Assignee: Winstron NeWeb Corp., Taipei Hsien (TW)

( * ) Notice: Subject to any disclaimer, the term of this patent is extended or adjusted under 35 U.S.C. 154(b) by 124 days.

(21) Appl. No.: 11/273,855

(22) Filed: Nov. 14, 2005

(65) Prior Publication Data

US 2007/0024503 A1 Feb. 1, 2007

(30) Foreign Application Priority Data

Jul. 29, 2005 (CN) ..... 94 2 12968 U

(51) Int. Cl.
*H01Q 1/38* (2006.01)

(52) U.S. Cl. ..... 343/700 MS

(58) Field of Classification Search ..... 343/700 MS, 343/702, 795, 797, 730, 729
See application file for complete search history.

(56) References Cited

U.S. PATENT DOCUMENTS 6,404,394 B1 * 6/2002 Hill ..... 343/702
6,747,605 B2 * 6/2004 Lebaric et al. ..... 343/795
6,859,176 B2 * 2/2005 Choi ..... 343/700 MS
2003/0020656 A1 * 1/2003 Shor ..... 343/700 MS
2004/0017315 A1 * 1/2004 Fang et al. ..... 343/700 MS
2004/0075609 A1 * 4/2004 Li ..... 343/700 MS

* cited by examiner

*Primary Examiner*—Huedung Mancuso
(74) *Attorney, Agent, or Firm*—Quintero Law Office

(57) ABSTRACT

An antenna structure comprises a substrate, a first conductive element, a feed point, a first extending element, two first radiation elements, two second radiation elements, a ground element, a signal line, and a ground line. The first conductive element is disposed on the substrate and extends in a first direction. The feed point is connected to an end of the first conductive element. The first extending element is connected to another end of the first conductive element opposite to the feed point and extends in the second direction. The first radiation elements are connected to two ends of the first extending element and extend in the first direction. The second radiation elements are connected to the first extending element, near the first radiation elements and extend in the first direction. The ground element is disposed on the substrate. The signal line is coupled to the feed point. The ground line is coupled to the ground element.

20 Claims, 11 Drawing Sheets

ANTENNA STRUCTURE

BACKGROUND

The invention relates to an antenna structure, and more particularly to an antenna structure for transmitting wireless network signals.

FIG. 1 shows a conventional antenna structure 1, which comprises a feed point 10, a conductive element 21, a conductive element 22, an impedance matching element 31, an impedance matching element 32, a radiator 41 and a radiator 42. The conductive element 21 is connected to the feed point 10. The impedance matching element 31 is connected to the conductive element 21. The radiator 41 is connected to the impedance matching element 31. The conductive element 22 is connected to the feed point 10. The impedance matching element 32 is connected to the conductive element 22. The radiator 42 is connected to the impedance matching element 32. The impedance matching element 31 is symmetrical to the impedance matching element 32. The radiator 41 is symmetrical to the radiator 42. The radiators 41 and 42 transmit wireless signal and transform impedance. The impedance matching elements 31 and 32 further transform impedance. The length d1 of the radiators 41 and 42 is about $\lambda/4$. The length d2 of the impedance matching elements 31 and 32 is about $\lambda/4$, wherein $\lambda$ is the wavelength of the wireless signal.

The conventional antenna structure 1 is longer as it comprises the impedance matching elements 31 and 32 for transforming impedance.

SUMMARY

An embodiment of an antenna structure for transmitting a wireless signal comprises a substrate, a first conductive element, a feed point, a first extending element, two first radiation elements, two second radiation elements, a ground element, a signal line, and a ground line. The first conductive element is disposed on the substrate and extends in a first direction. The feed point is connected to an end of the first conductive element. The first extending element is connected to another end of the first conductive element opposite to the feed point and extends in a second direction. The first radiation elements are connected to two ends of the first extending element and extend in the first direction. The second radiation elements are connected to the first extending element, near the first radiation elements and extend in the first direction. The ground element is disposed on the substrate. The signal line is coupled to the feed point. The ground line is coupled to the ground element.

The antenna structure is disposed in a housing of an electronic device.

The antenna structure omits the impedance matching elements of the conventional antenna structure. The length of the antenna structure is thus reduced by about $\lambda/2$.

DESCRIPTION OF THE DRAWINGS

The invention will be more fully understood from the following detailed description and the accompanying drawings, given by the way of illustration only and thus not intended to limit the invention.

DETAILED DESCRIPTION

Figure 1:
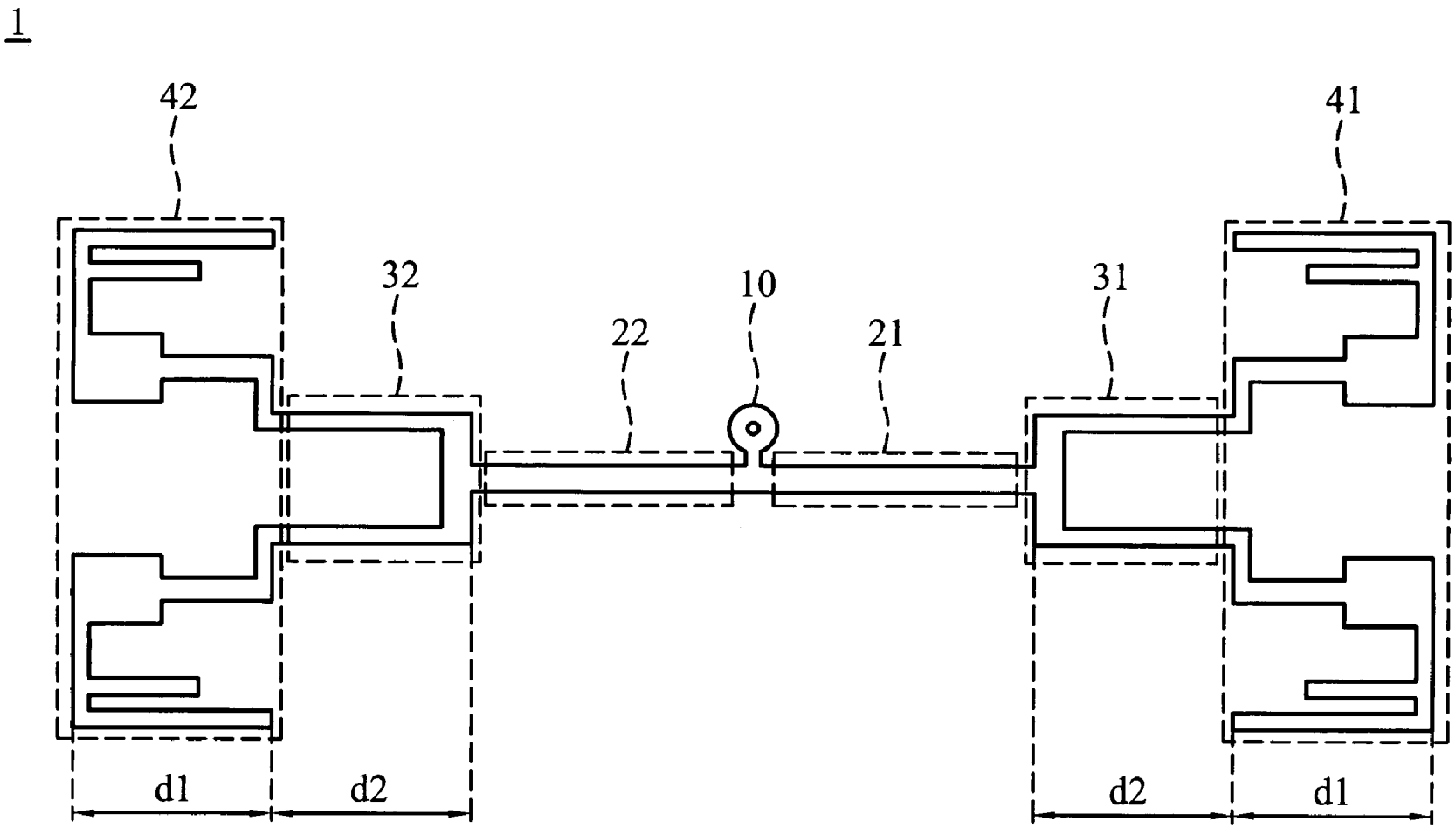
FIG. 1 (RELATED ART)
FIG. 1 shows a conventional antenna structure.
Figure 2A:
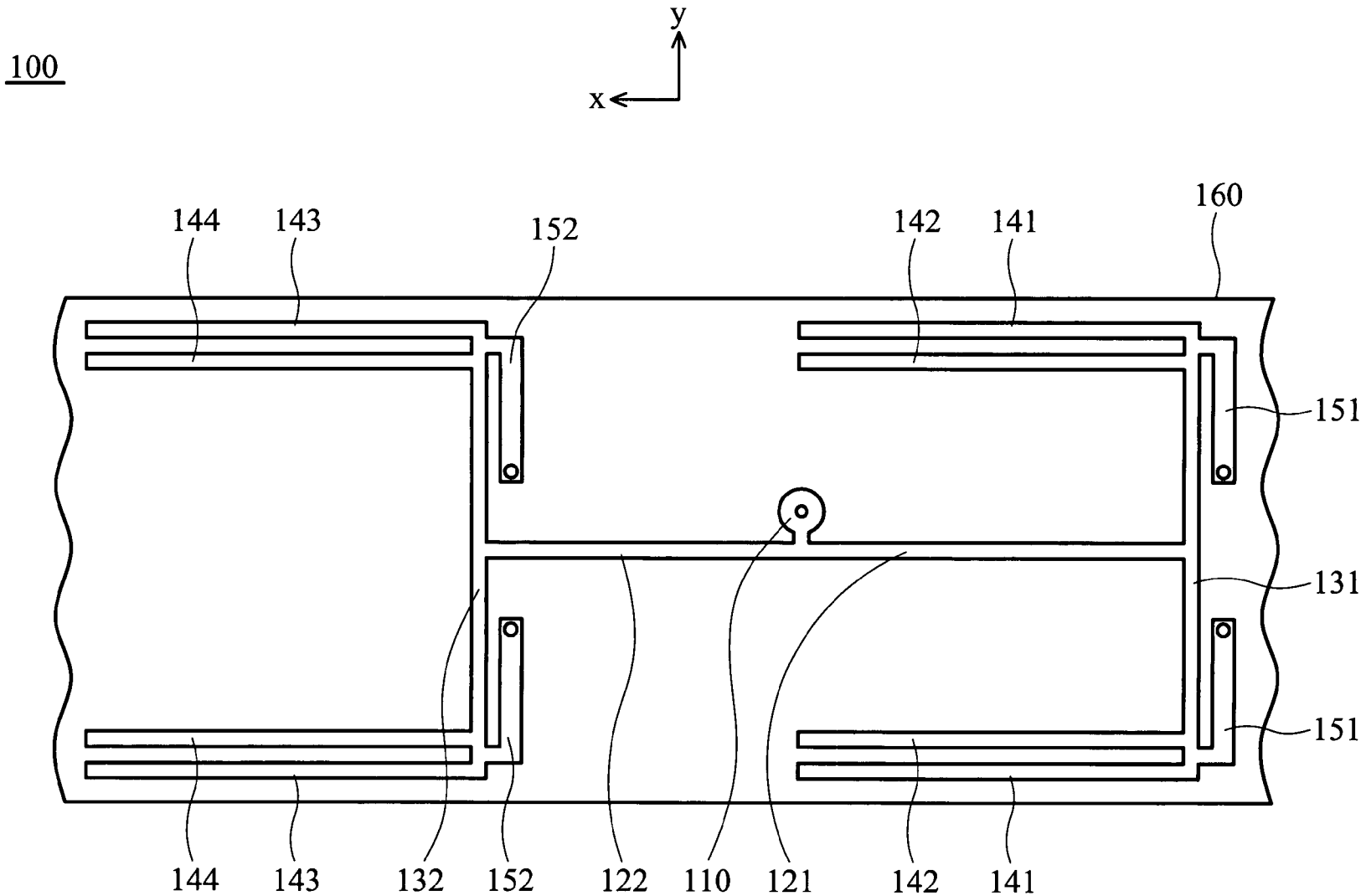
FIG. 2*a* is a top view of an antenna structure of a first embodiment of the invention.

FIG. 2*a* shows an antenna structure 100 of a first embodiment of the invention, which comprises a feed point 110, a first antenna unit (comprising a first conductive element 121, a first extending element 131, first radiation elements 141, second radiation elements 142 and first L-shaped elements 151), a second antenna unit (comprising a second conductive element 122, a second extending element 132, third radiation elements 143, fourth radiation elements 144 and second L-shaped elements 152) and a substrate 160. The substrate 160 comprises a first surface (front surface) and a second surface (back surface). The first antenna unit and the second antenna unit are disposed on the first surface. The first conductive element 121 and the second conductive element 122 are longitudinal, extending in a first direction x, and disposed on a straight line. The feed point 110 is disposed between the first conductive element 121 and the second conductive element 122. The first extending element 131 is longitudinal, connected to an end of the first conductive element 121 opposite to the feed point 110, and extends in a second direction y. The second direction y is perpendicular to the first direction x. The first radiation elements 141 are connected to the two ends of the first extending element 131 and extend in the first direction x. The second radiation elements 142 are connected to the first extending element 131, near the first radiation elements 141 and extend in the first direction x. The first L-shaped elements 151 are connected to the first extending element 131. The second extending element 132 is longitudinal, connected to an end of the second conductive element 122 opposite to the feed point 110, and extends in the second direction y. The third radiation elements 143 are connected to the two ends of the second extending element 132 and extend in the first direction x. The fourth radiation elements 144 are connected to the second extending element 132, near the third radiation elements 143 and extend in the first direction x. The second L-shaped elements 152 are connected to the second extending element 132.

Figure 2B:
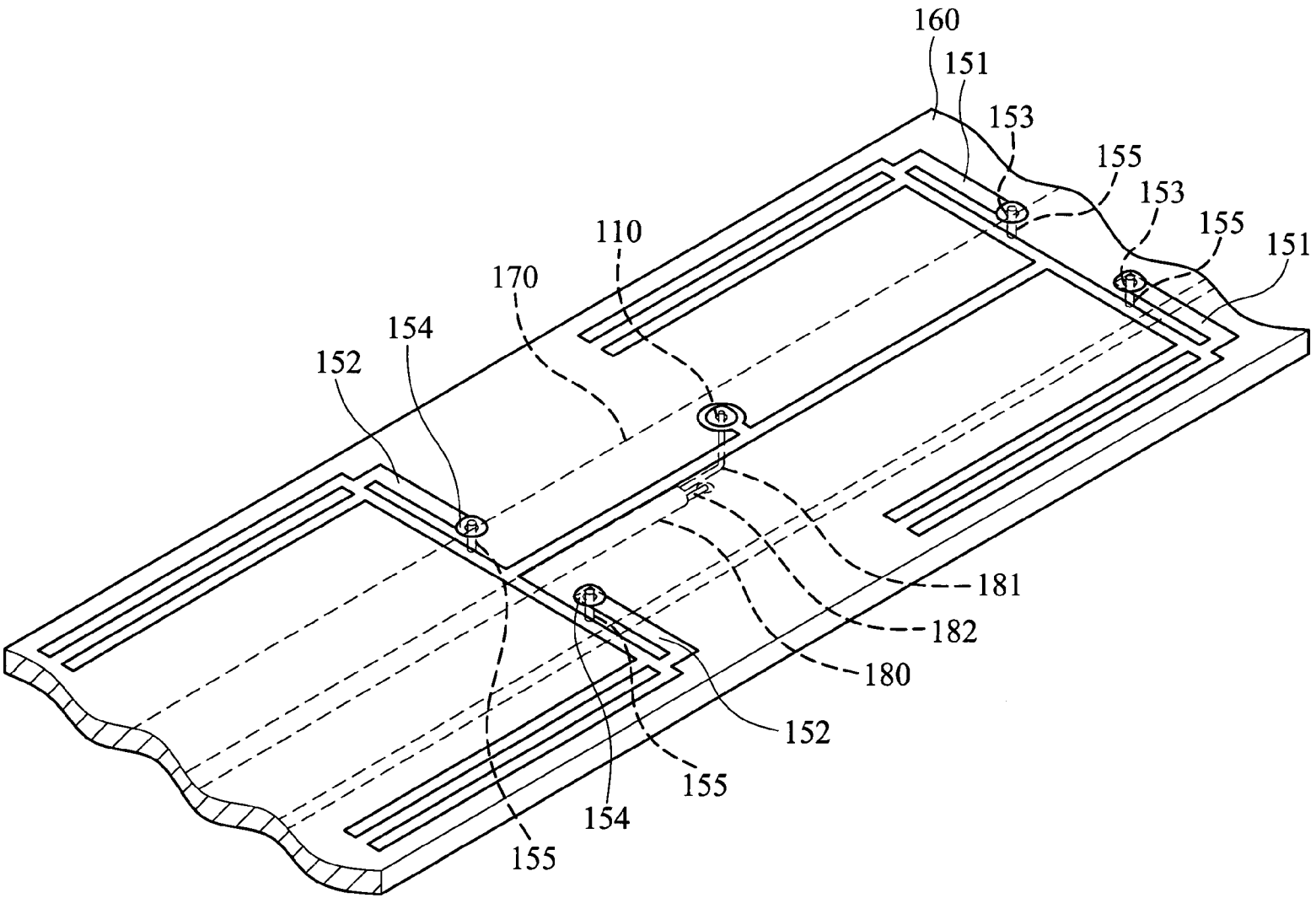
FIG. 2*b* is a perspective view of the antenna structure of the first embodiment of the invention.
Figure 2C:
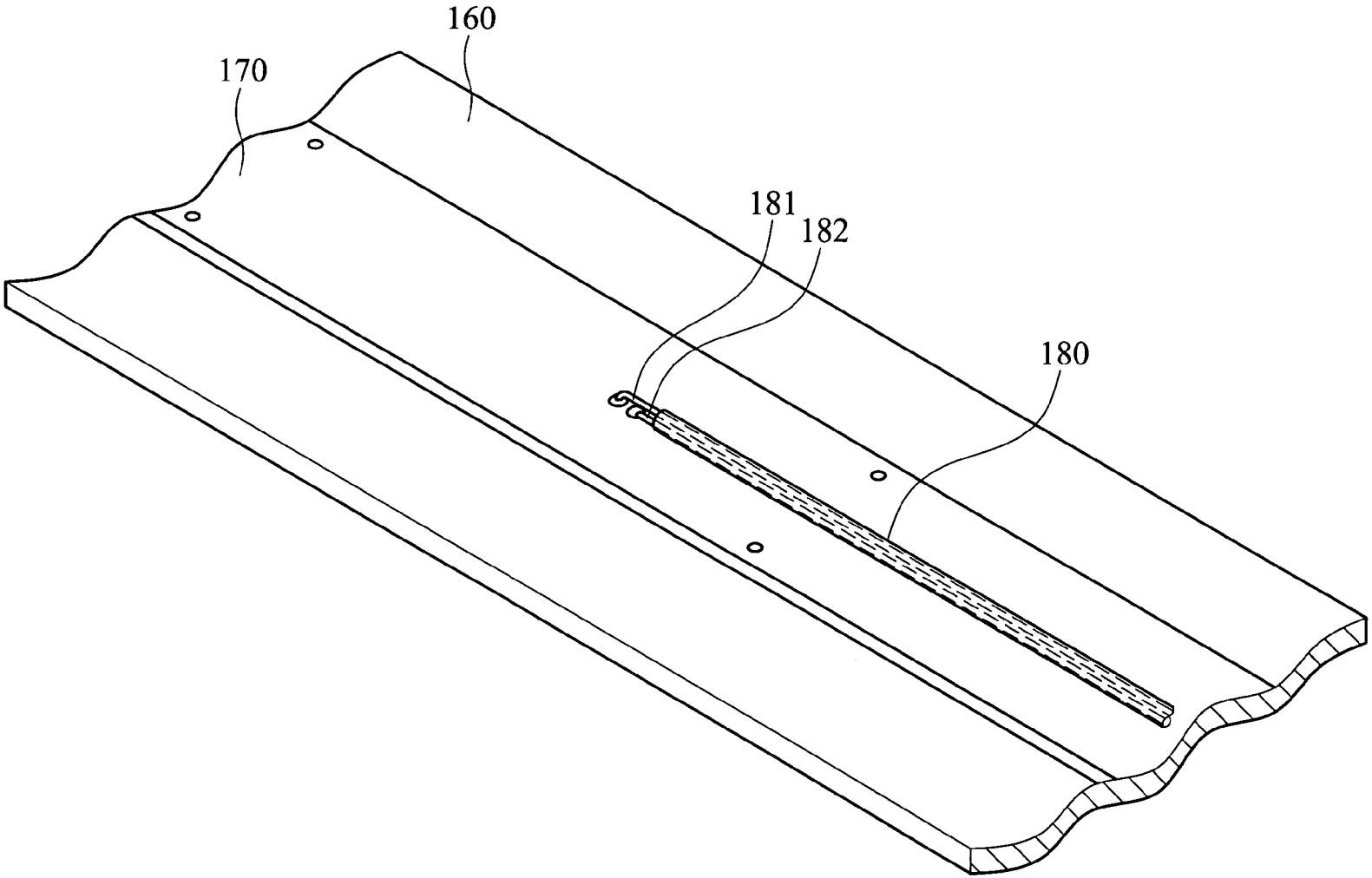
FIG. 2*c* shows the detailed structure on the second surface of the antenna structure of the first embodiment.

With reference to FIG. 2*b*, the first L-shaped elements 151 comprise ground ends 153. Conductive wires 155 couple the ground ends 153 of the first L-shaped elements 151 to the ground element 170 on the second surface of the substrate 160. The second L-shaped elements 152 comprise ground ends 154. Conductive wires 155 couple the ground ends 154 to the ground element 170. The feed point 110 is coupled to a signal line 181. With reference to FIG. 2*c*, a cable 180 comprises the signal line 181 and a ground line 182. The signal line 181 is coupled to the feed point 110 passing the ground element 170 and the substrate 160. The ground line 182 is coupled to the ground element 170.

Figure 3A:
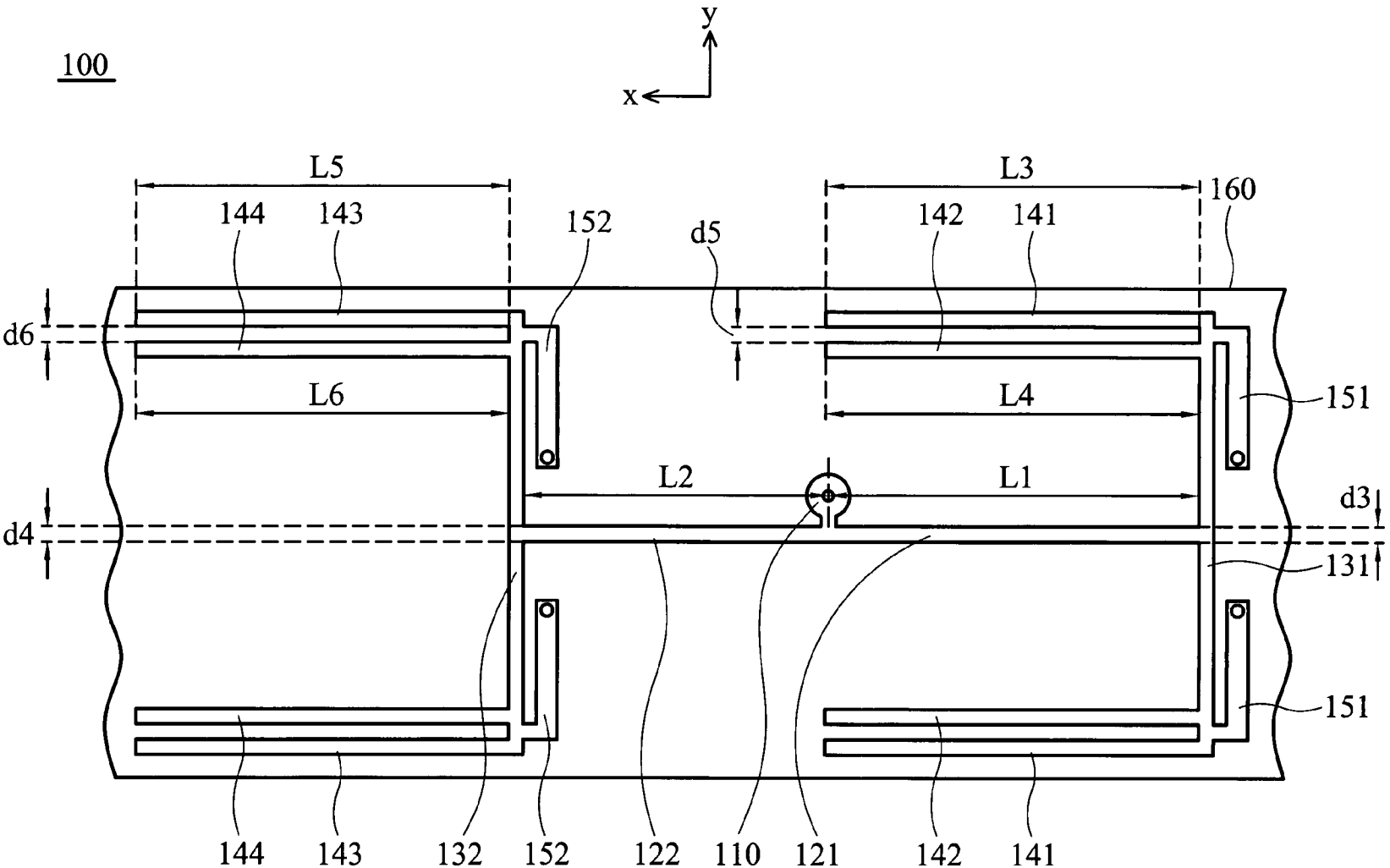
FIG. 3*a* shows parameters relating to signal transmission.

With reference to FIG. 3*a*, the length L1 of the first conductive element 121 can be changed to modify a radiation pattern of the antenna structure 100. The width d3 of the first conductive element 121 can be changed to modify impedance matching of the antenna structure 100. The length L2 of the second conductive element 122 can be changed to modify the radiation pattern of the antenna structure 100. The width d4 of the second conductive element 122 can be changed to modify impedance matching of the antenna structure 100. A gap d5 between the first radiation element 141 and the nearby second radiation element 142 can be changed to modify impedance matching and gain of the antenna structure 100. A gap d6 between the third radiation element 143 and the nearby fourth radiation element 144 can be changed to modify impedance matching and gain of the antenna structure 100. The length L3 of the first radiation elements 141, the length L4 of the second radiation elements 142, the length L5 of the third radiation elements 143 and the length L6 of the fourth radiation elements 144 are λ/4, wherein λ is the wave length of the wireless signal.

Figure 3B:
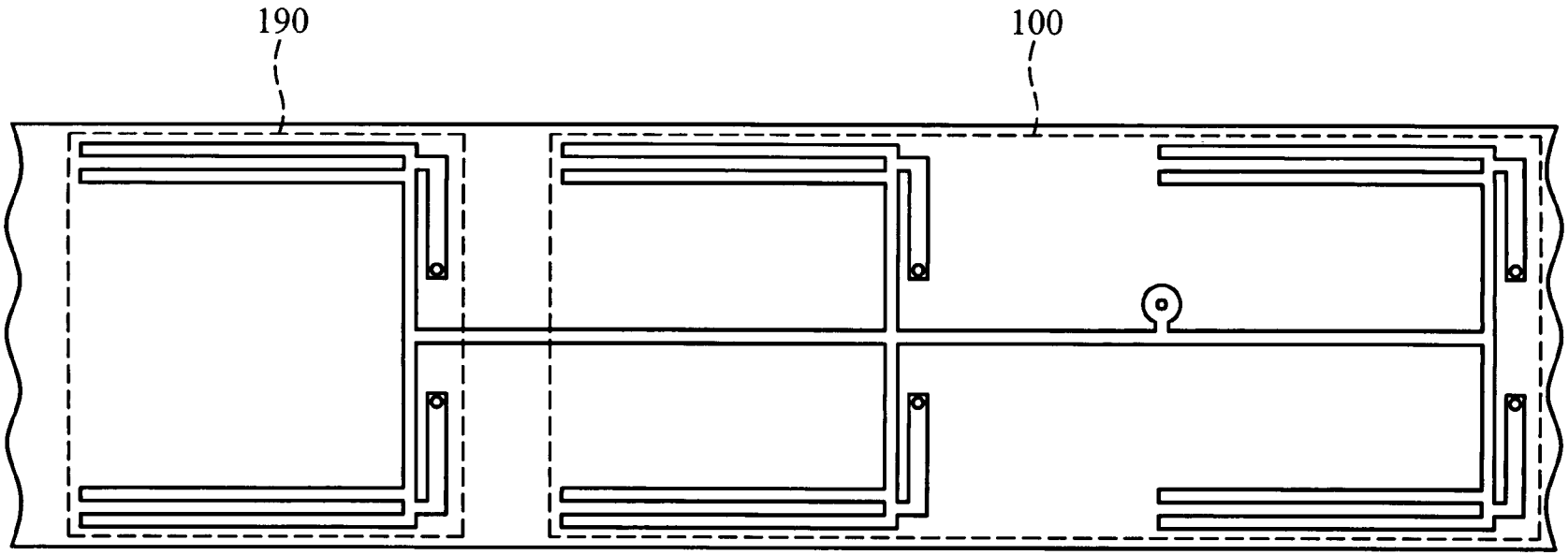
FIG. 3*b* shows a third antenna unit disposed on the antenna structure of the first embodiment.

The second antenna unit (comprising the second conductive element 122, the second extending element 132, the third radiation elements 143, the fourth radiation elements 144 and the second L-shaped elements 152) can be omitted, and the antenna structure 100 can transmit the wireless signal via the feed point 110, the first antenna unit (comprising the first conductive element 121, the first extending element 131, the first radiation elements 141, the second radiation elements 142 and the first L-shaped elements 151), the substrate 160 and the ground element 170. With reference to FIG. 3*b*, the antenna structure 100 further comprises a third antenna unit 190 connected to the second antenna unit to achieve a more symmetrical radiation pattern. The shape of the third antenna unit 190 is the same as the shape of the second antenna unit.

The antenna structure 100 omits the impedance matching elements of the conventional antenna structure. The length of the antenna structure is thus reduced by about λ/2.

The antenna structure 100 of the invention is a dipole antenna. However, the antenna structure 100 can omit the first L-shaped elements and the second L-shaped elements to be a monopole antenna.

Figure 4:
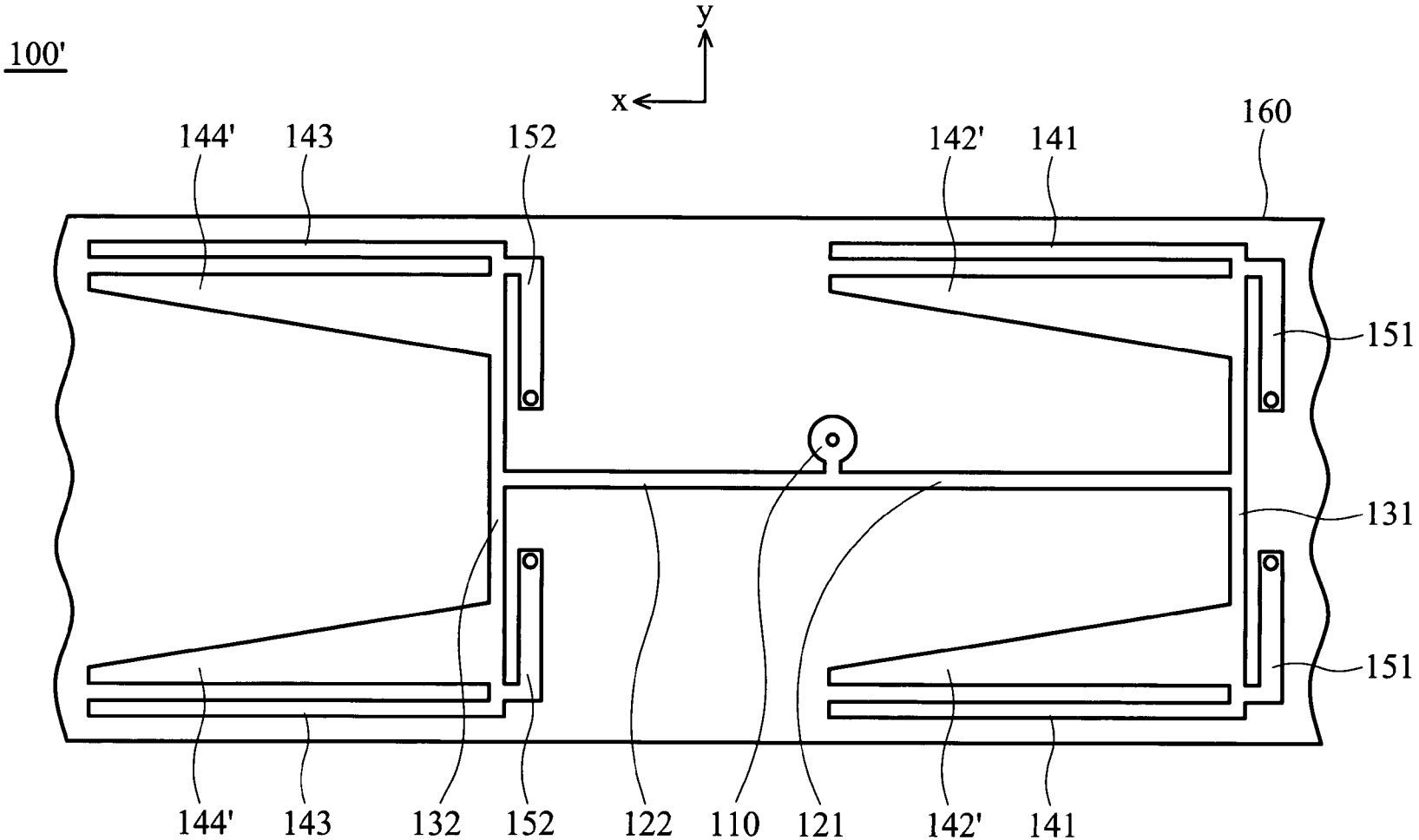
FIG. 4 is a top view of an antenna structure of a second embodiment of the invention.

FIG. 4 shows an antenna structure 100' of a second embodiment of the invention, wherein the second radiation elements 142' and the fourth radiation elements 144' are triangular shaped to change signal transmitting frequency of the antenna structure 100'.

Figure 5:
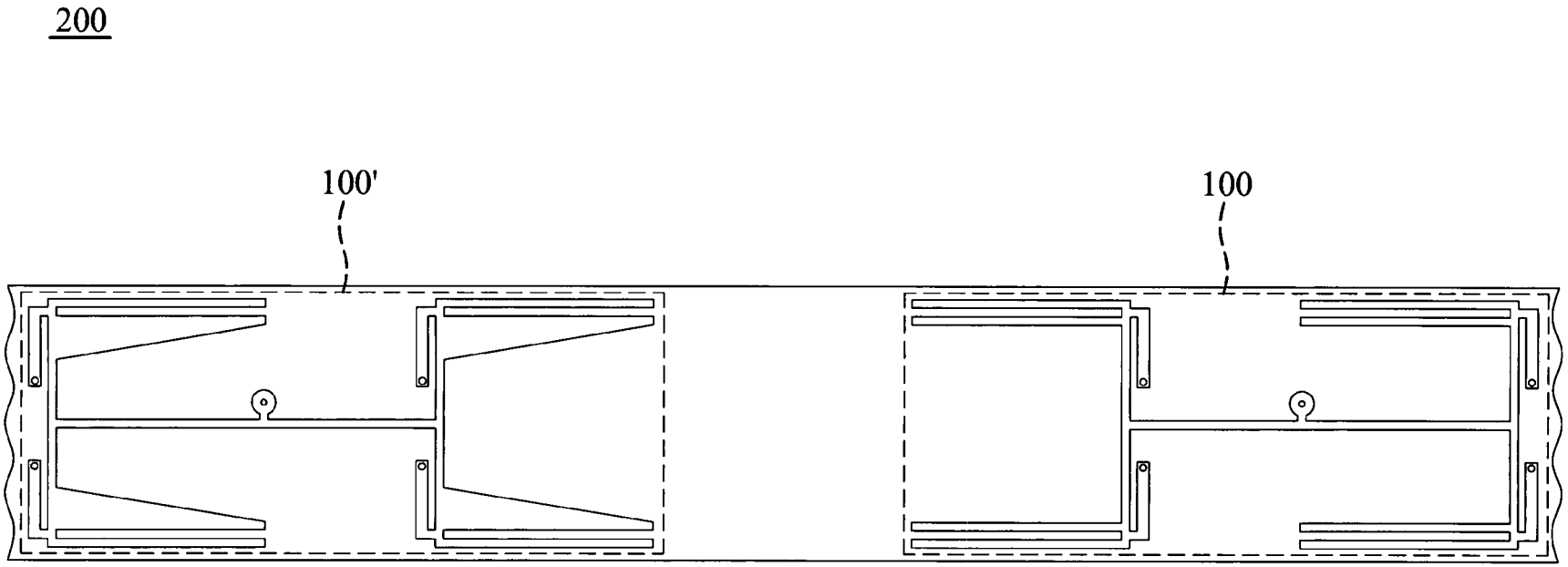
FIG. 5 is a top view of an antenna structure of a third embodiment of the invention.

FIG. 5 shows an antenna structure 200 of a third embodiment of the invention, which combines the antenna structure 100 of the first invention and the antenna structure 100' of the second invention to transmit wireless signals with different bandwidths.

Figure 6:
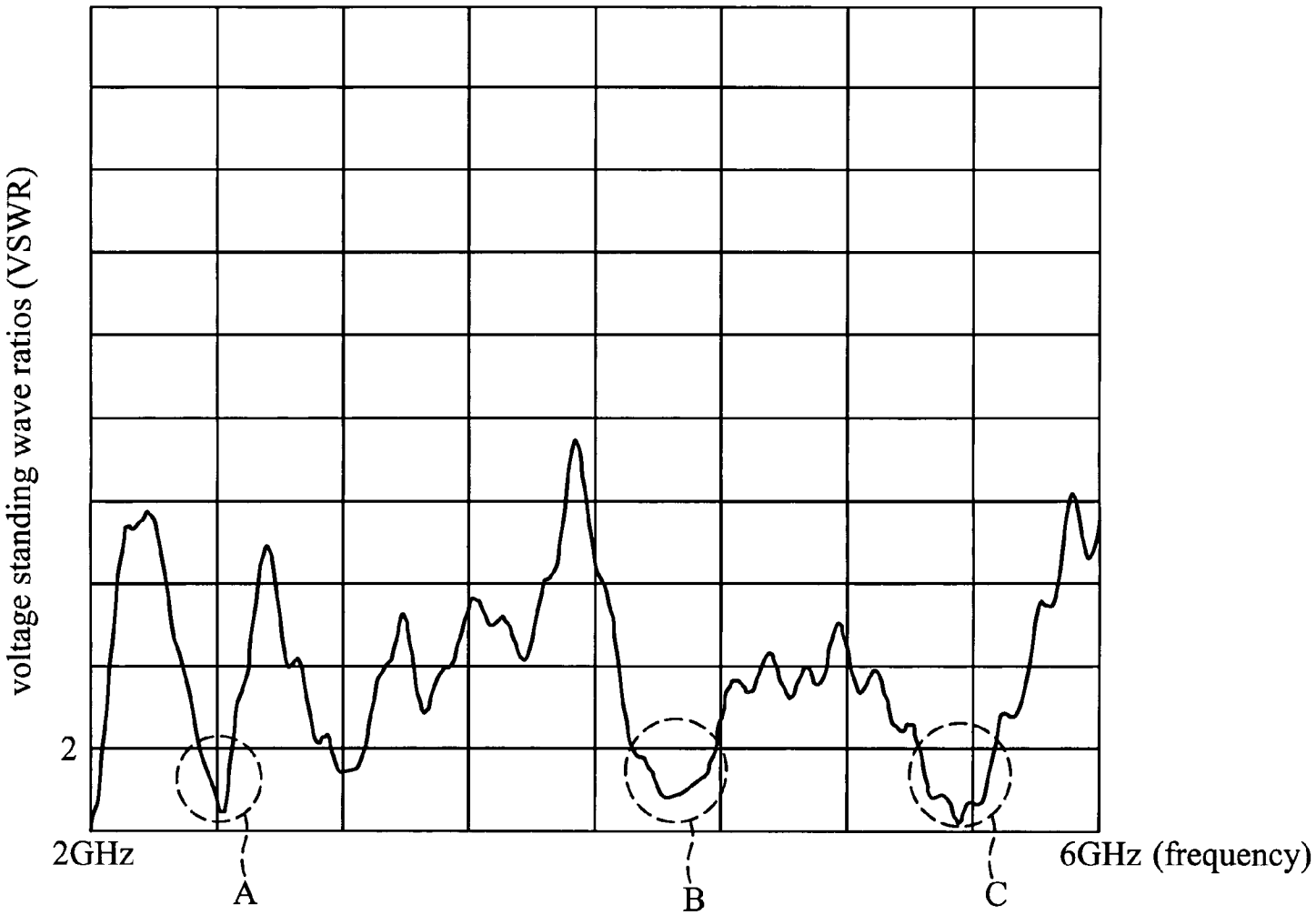
FIG. 6 shows signal transmission of the antenna structure of the third embodiment.

The antenna structure 200 can transmit wireless signals in three different bandwidths. FIG. 6 shows signal transmission of the antenna structure 200, wherein the bands thereof (bands are defined as signals having voltage standing wave ratios lower than 2) comprises band A, band B and band C. The frequency of the band A is 2.44~2.56 GHz. The frequency of the band B is 4.20~4.50 GHz. The frequency of the band C is 5.30~5.60 GHz.

Figure 7:
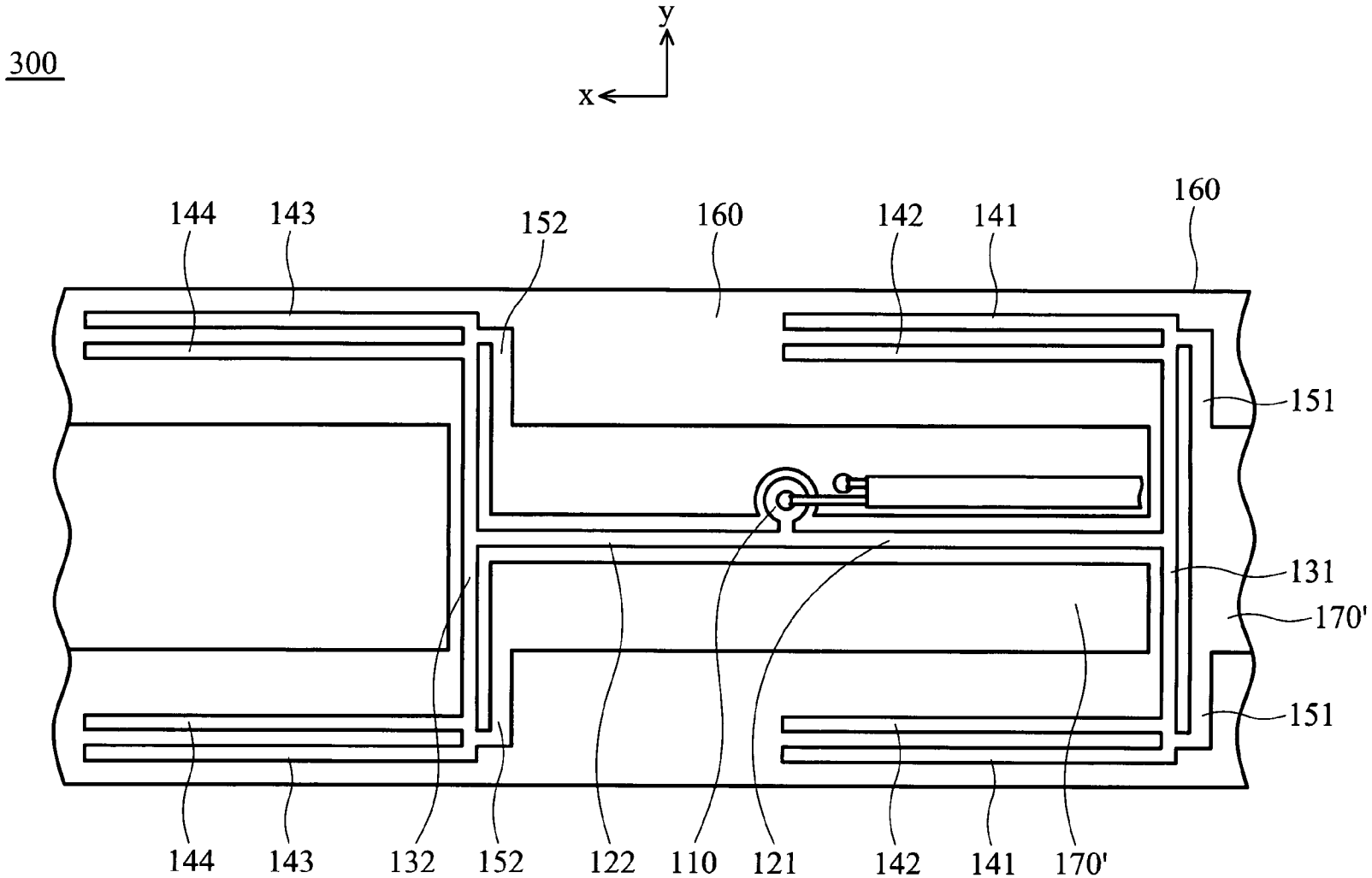
FIG. 7 shows an antenna structure of a fourth embodiment of the invention.

FIG. 7 shows an antenna structure 300 of the fourth embodiment of the invention, wherein the ground element 170' is disposed on the first surface of the substrate 160, and the first L-shaped elements 151 and the second L-shaped elements 152 are directly connected to the ground element 170'.

The antenna structures in the first, second, third and fourth embodiments are utilized in transmitting various wireless signals, particularly signals conformed to IEEE 802.11(b) and IEEE 802.11(g).

Figure 8:
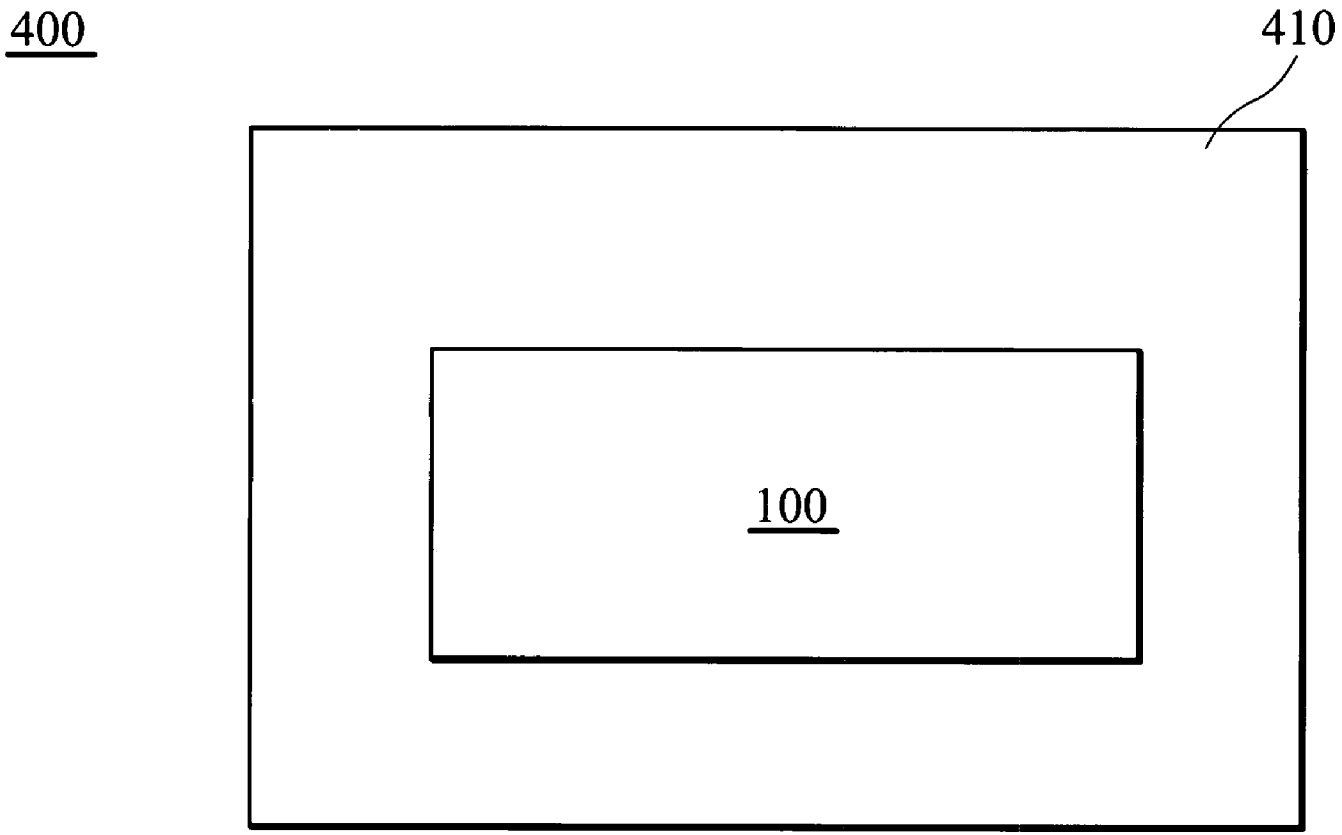
FIG. 8 shows the antenna structure of the invention disposed in an electronic device.

With reference to FIG. 8, the antenna structure 100 is disposed in a housing 410 of an electronic device 400 (such as a wireless network device), and so are the antenna structures of the second, third and fourth embodiments.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna structure for transmitting a wireless signal, comprising:

a substrate;

a first conductive element, disposed on the substrate and extending in a first direction;

a feed point, connected to an end of the first conductive element;

a first extending element, connected to another end of the first conductive element opposite to the feed point, and extending in a second direction perpendicular to the first direction;

two first radiation elements, connected to two ends of the first extending element and extending in the first direction;

two second radiation elements, connected to the first extending element, near the first radiation elements and extending in the first direction;

a ground element, disposed on the substrate;

two first L-shaped elements, separately connected to the first extending element and electrically connected to the ground element;

a signal line, electrically connected to the feed point; and a ground line, electrically connected to the ground element.

2. The antenna structure as claimed in claim 1, wherein the first radiation elements are longitudinal.

3. The antenna structure as claimed in claim 2, wherein the length of the first radiation elements is λ/4, and λ is the wave length of the wireless signal.

4. The antenna structure as claimed in claim 1, wherein the second radiation elements are longitudinal.

5. The antenna structure as claimed in claim 4, wherein the length of the second radiation elements is λ4, and λ is the wave length of the wireless signal.

6. The antenna structure as claimed in claim 1, wherein the second radiation elements are triangular shaped.

7. The antenna structure as claimed in claim 1, further comprising:

a second conductive element, disposed on the substrate on the same side as the first conductive element and extending in the first direction, wherein an end of the second conductive element is connected to the feed point;

a second extending element, connected to another end of the second conductive element opposite to the feed point, and extending in the second direction;

two third radiation elements, connected to two ends of the second extending element and extending in the first direction; and two fourth radiation elements, connected to the second extending element, near the third radiation elements and extending in the first direction.

8. The antenna structure as claimed in claim 7, further comprising two second L-shaped elements, connected to the second extending element and electrically connected to the ground element.

9. The antenna structure as claimed in claim 7, wherein the third radiation elements are longitudinal.

10. The antenna structure as claimed in claim 7, wherein the length of the third radiation elements is $\lambda/4$, and $\lambda$ is the wave length of the wireless signal.

11. The antenna structure as claimed in claim 7, wherein the fourth radiation elements are longitudinal.

12. The antenna structure as claimed in claim 7, wherein the length of the fourth radiation elements is $\lambda/4$, and $\lambda$ is the wave length of the wireless signal.

13. The antenna structure as claimed in claim 7, wherein the shape of the fourth radiation elements is triangular.

14. The antenna structure as claimed in claim 1, wherein the substrate comprises a first surface and a second surface opposite to the first surface.

15. The antenna structure as claimed in claim 14, wherein the first conductive element is disposed on the first surface, and the ground element is disposed on the second surface.

16. An electronic device, comprising:

a housing; and the antenna structure as claimed in claim 1, wherein the antenna structure is disposed in the housing.

17. The electronic device as claimed in claim 16, wherein the electronic device is a wireless network device.

18. An electronic device, comprising:

a housing; and the antenna structure as claimed in claim 15, wherein the antenna structure is disposed in the housing.

19. The electronic device as claimed in claim 18, wherein the electronic device is a wireless network device.

20. The electronic device as claimed in claim 1, wherein the first radiation elements are longitudinal, the second radiation elements are longitudinal, and the length of the first radiation elements equals the length of the second radiation elements.

* * * * *

UNITED STATES PATENT AND TRADEMARK OFFICE

CERTIFICATE OF CORRECTION

PATENT NO. : 7,321,333 B2
APPLICATION NO. : 11/273855
DATED : January 22, 2008
INVENTOR(S) : Feng-Chi Eddie Tsai and Chia Tien Li It is certified that error appears in the above-identified patent and that said Letters Patent is hereby corrected as shown below:

On the Title Page, Item (73) Assignee should read

--Assignee:

Wistron NeWeb Corp., Taipei Hsien (TW)--.

Signed and Sealed this

Tenth Day of June, 2008

JON W. DUDAS
*Director of the United States Patent and Trademark Office*